US010183188B2

(12) United States Patent
Burke

(10) Patent No.: US 10,183,188 B2
(45) Date of Patent: Jan. 22, 2019

(54) EXERCISE RING ACCESSORY TO AID IN RING STRENGTH TRAINING

(71) Applicant: Patrick Burke, Westminster, CO (US)

(72) Inventor: Patrick Burke, Westminster, CO (US)

(73) Assignee: False Grip LLC, Westminster, CO (US)

( * ) Notice: Subject to any disclaimer, the term of this patent is extended or adjusted under 35 U.S.C. 154(b) by 0 days.

(21) Appl. No.: 15/478,009

(22) Filed: Apr. 3, 2017

(65) Prior Publication Data

US 2017/0296856 A1 Oct. 19, 2017

Related U.S. Application Data

(60) Provisional application No. 62/318,019, filed on Apr. 4, 2016.

(51) Int. Cl.

| | |
|---|---|
| ***A63B 7/02*** | (2006.01) |
| ***A63B 21/00*** | (2006.01) |
| ***A63B 71/14*** | (2006.01) |

(52) U.S. Cl.

CPC ..... *A63B 7/02* (2013.01); *A63B 21/4019* (2015.10); *A63B 21/4033* (2015.10); *A63B 71/14* (2013.01); *A63B 2210/50* (2013.01)

(58) Field of Classification Search

CPC ... A63B 7/02; A63B 21/4019; A63B 21/4033; A63B 71/14; A63B 2210/50

See application file for complete search history.

(56) References Cited

U.S. PATENT DOCUMENTS

| | | | | |
|---|---|---|---|---|
| 5,681,243 | A * | 10/1997 | Criss | A63B 21/028 482/49 |
| 9,468,806 | B2 | 10/2016 | Newman | |
| 2014/0121064 | A1* | 5/2014 | Newman | A63B 23/16 482/49 |
| 2015/0126334 | A1* | 5/2015 | Newman | A63B 7/02 482/24 |

* cited by examiner

*Primary Examiner* — Joshua Lee
(74) *Attorney, Agent, or Firm* — Neugeboren O'Dowd PC

(57) ABSTRACT

The present invention is an exercise ring accessory device that quickly inserts onto a set of exercise rings for ring strength training as used in gymnastics, cross-fit, and other strength programs that utilize exercise rings. The quickness and ease of installation and removal is a great value for coaches and users, as they can work more drills in less time. The device also provides a comfortable grip, and includes a cutout on the underside, allowing an elastic support band to be placed underneath device to give support to users of varying skill levels.

14 Claims, 6 Drawing Sheets

EXERCISE RING ACCESSORY TO AID IN RING STRENGTH TRAINING

CLAIM OF PRIORITY

This application claims the benefit of U.S. Provisional Patent Application No. 62/318,019 filed Apr. 4, 2016, which is incorporated by reference in its entirety.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND

1. Field of the Invention

The present invention relates to a novel device that is easily placed on a standard piece of gymnastic equipment to provide support and comfort in gymnastic ring training. More specifically, this invention is an exercise ring accessory device that provides a comfortable area to place the hand while doing gymnastic ring training and can easily be inserted or removed from a standard set of gymnastic rings without requiring the user to remove the gymnastic rings or permanently alter them in any way. Additionally, the device contains a cut out area where a user can utilize elastic assistance bands while they are building strength during ring training.

2. Background

Gymnastic ring work requires a significant amount of grip and arm strength that most beginners do not have. Users must learn to control the rings for several maneuvers, and proper use requires control of the rings that many users cannot maintain. Many users are unable to correctly control the gymnastic rings, or they find the narrow wood rings uncomfortable on their hands, which leads to hand shifting, resulting in improper muscle movement and sometimes injury. Users are often faced with the problem of risking significant harm while beginning gymnastic ring work use. As a result, a user may fail to develop the necessary strength to perform simple or advanced skills, and may form bad habits which can result in injury.

This invention easily attaches to a standard set of gymnastic rings with no screws, clips, or adhesives, and thus and can be instantly removed. It will not permanently alter the rings in any way. Application and removal of the device can be done by users with little to no instruction and requires no advanced knowledge of how to correctly grip the device. The device also contains an area where elastic bands can be placed to provide assistance while doing exercises depending on the needs of the user. This device is extremely useful to any gymnastic strength training facility because a coach or user can attach and remove it in a matter of seconds, without having to remove the rings from the ceiling, their attachments, or alter them in any way. Thus any training facility can accommodate many skill levels in a class using the device with existing exercise rings.

Current technology consists of a device with a platform that is permanently affixed to the side of the ring itself. Thus, in order for a coach or user to switch between stand-alone gymnastic rings and those utilizing the existing device, the standard gymnastic rings must be removed from their ceiling support straps, and the existing device must be swapped in. This is time consuming and may require many facilities that offer exercise ring training to own multiple sets of regular and altered rings, which can be a large barrier for gyms and coaches that operate with large group classes. The existing device makes it cumbersome to switch between rings with and without it, athletes and coaches will utilize it less frequently, resulting in a lack of progression for athletes.

The present invention provides a solution to the cost-prohibitive, under-utilized, and inefficient technology that currently exists. The device saves coaches and users time because it can instantly be affixed to standard rings when needed, and can easily be removed when not in use—all without removing the ring straps from the ceiling. The device's contoured design aids in the comfort and grip for the user. Further, and unlike existing technology, the device has cut outs that allow the use of different sized elastic support bands, offering the athlete varying levels of additional aid while performing movements. This provides the athlete with a clear path as they move forward in training. The attachment can therefore be utilized for training through a variety of levels, and can easily be adjusted based on the needs of each user, even if they are training simultaneously. The ease of attachment and removal, improved grip design over the center of the rings, and the ability to safely add supporting bands both demonstrate substantial improvement and advancement over existing technology, all while allowing the facility to easily convert rings they already own into a highly-effective tool for training multiple levels of athletes.

The device can be made of hard rubber that supports and comforts the hand while providing a sturdy grip. The material that will allow manufacturers to keep production costs low. Additionally, contoured design and texture on the device aid in providing a confident grip that acts to engage more muscles during movements, and holds chalk to keep the hands dry during training movements.

Statement Of The Invention

The present invention is comprised of a design is easily placed inside and sturdily over a standard pair of gymnastic rings. It provides a stable and firm grip for athletes to ensure correct positioning for use of the ring for many exercises used in gymnastics and ring strength training. This increases the user's understanding correct form and hand placement for the movements, and allows for safer, quicker strength development. Cut outs allow for bands of different sizes to be used for assistance based on the needs of the user. This means that the same attachment can be used for various levels of strength training. Because the device, and any assistance bands, can quickly be attached or removed, coaches can more efficiently train athletes of all levels. It is an especially useful tool to support beginners. Consequently, the present invention provides users with a more efficient way to build strength. In sum, the efficiency, comfort, and ease of use of this device are all substantially different and superior in those ways to existing technology—which will result in vastly more use by coaches, and safer, faster results for users.

BRIEF DESCRIPTION OF THE DRAWINGS

The present invention is illustrated through the attached images as an example and is not limited by the accompanying figures in which.

DETAILED DESCRIPTION OF THE INVENTION

The present disclosure relates to an exercise ring accessory device that quickly and easily attaches to, and is removed from, a standard set of exercise rings. The device is used while performing many different gymnastic exercises and offers a textured grip area centered over the rings. Additionally, band cutouts on the underside allow for elastic support bands to be used for beginners.

Figure 1:
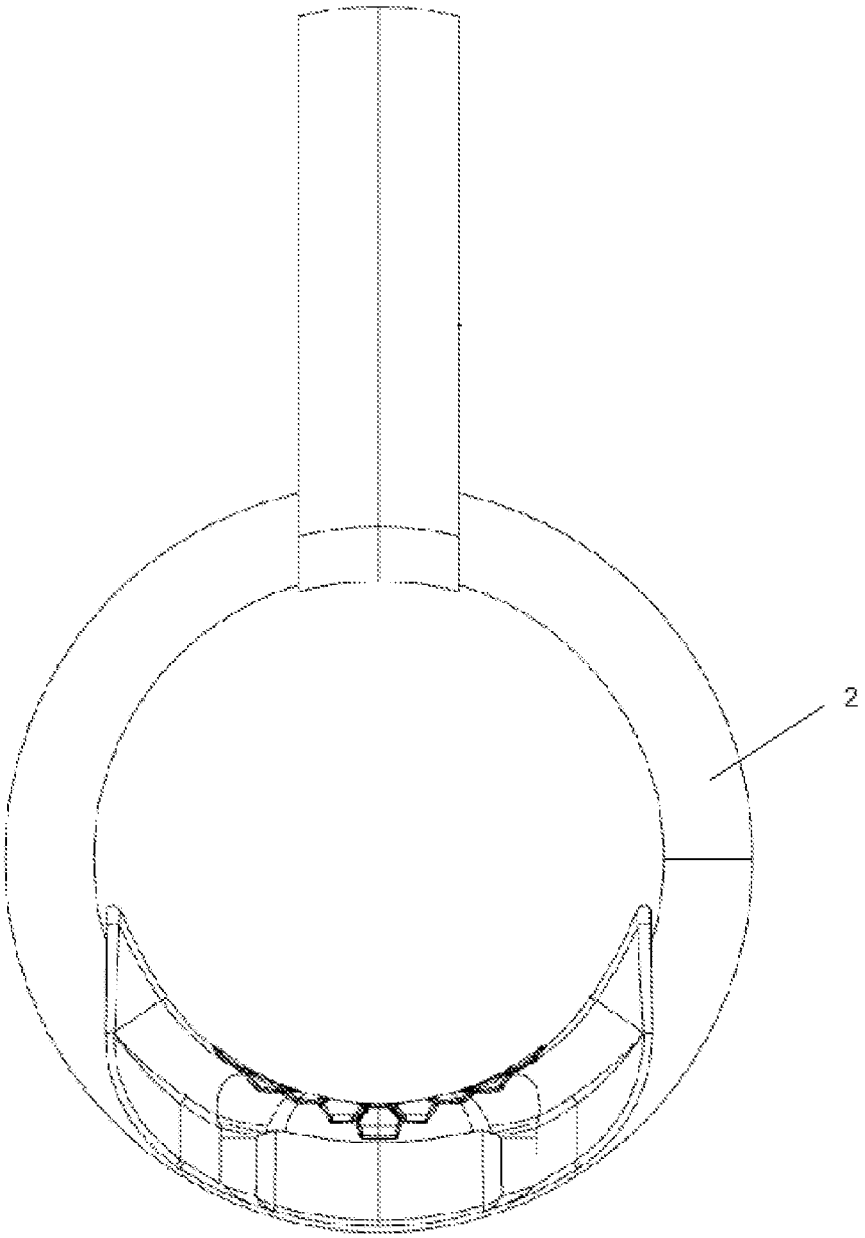
FIG. 1: This image illustrates a side view of the detachable exercise ring accessory device as it is seated on the exercise ring.

FIG. 1 shows a side view of the exercise ring accessory device as attached to an exercise ring 2. This view demonstrates the curvature and fit of the device to the top and lateral sides of the ring 2. The device length fits within the inside diameter of the rings. In some embodiments, the device could be shorter or longer, covering more or less of the top and lateral surface of the rings.

Figure 2:
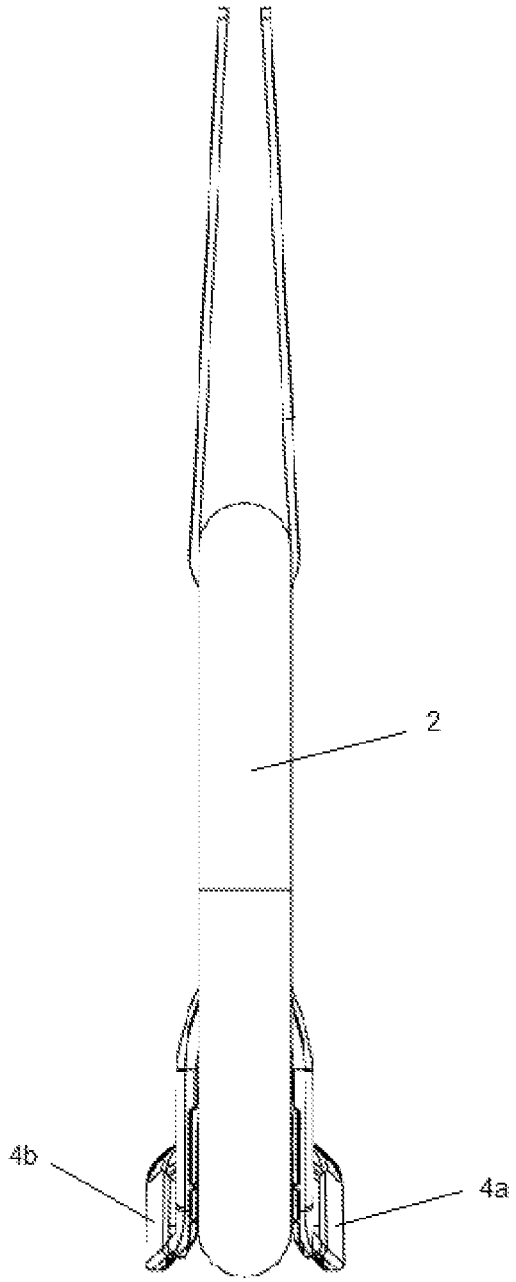
FIG. 2: This image illustrates a front/rear view of the detachable exercise ring accessory device as it is seated on the exercise ring.

FIG. 2 illustrates the front/rear view of the ring accessory device as attached to an exercise ring 2 and the width of the material covering the band cutout area 4(*a*) and 4(*b*). Seen better in FIG. 3 and FIG. 7, the material covering the band cutout area 4(*a*) and 4(*b*) gradually tapers in thickness from its widest point at the center and narrowest point at the ends where the cutout area ends on the underside of the device. In some embodiments, the material covering the band cutout area could maintain a steady thickness running parallel to the rings 2 without a taper. The tapering over the band area increases surface area, which provides a more comfortable grip, and allows users with different sized hands to find varied areas to grip.

Figure 3:
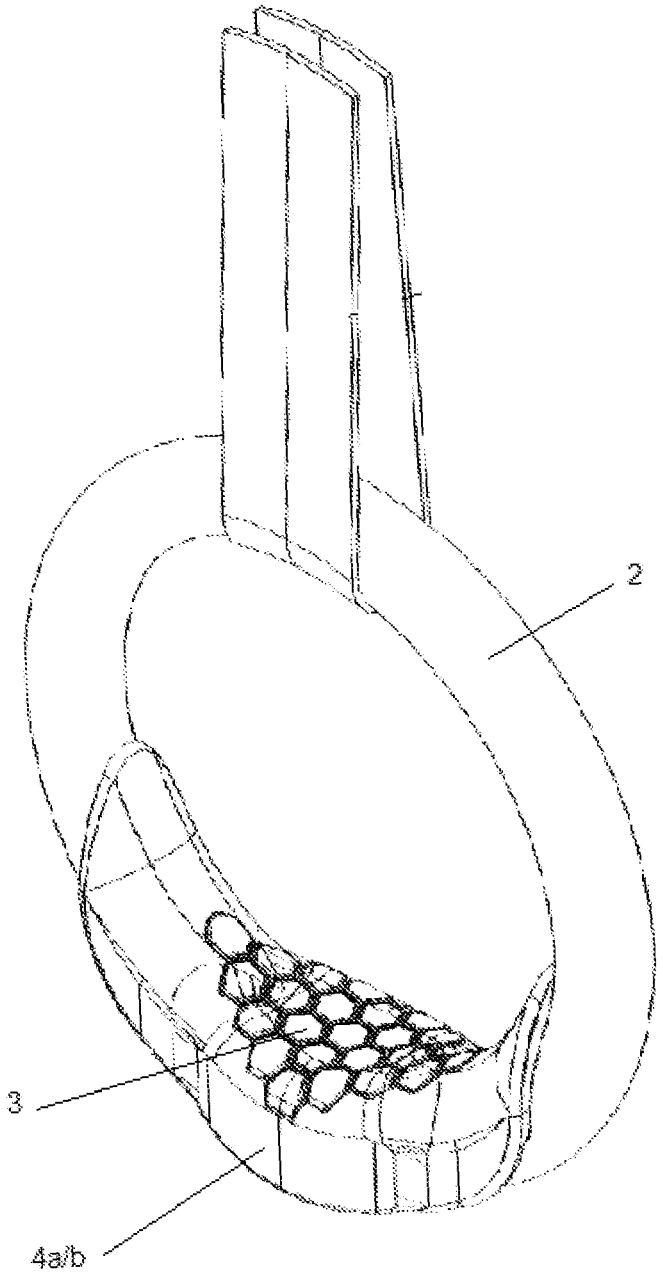
FIG. 3: This image illustrates a top view of the detachable exercise ring accessory device as it is seated on the exercise ring.
Figure 4:
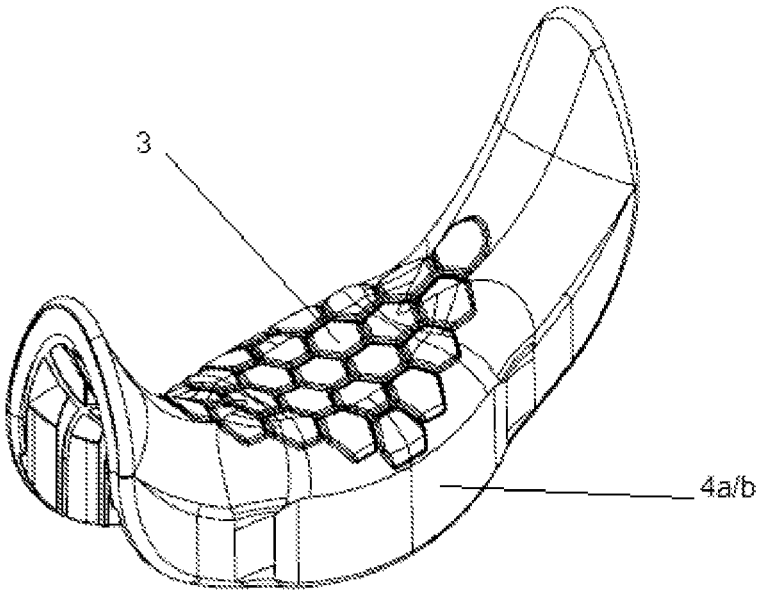
FIG. 4: This image illustrates a top view of the detachable exercise ring accessory device.

FIG. 3 and FIG. 4 show a top view of the exercise ring accessory. This view shows the textured grip area 3 where a user would place their hands for improved grip and comfort. The textured grip area 3 serves as tread to increase friction and grip control as well as maintain hand chalk, which aids in keeping skin dry during training. In this embodiment, the texture is of a honey-comb shape and molded to a minimal depth as a piece of the device itself. Different embodiments of the device, could utilize different shapes, texture designs, and patterns at higher and lower depths. Other embodiments could utilize a secondary material made of softer rubber or similar composite that offers improved grip to the user's hand. The overall goal of the grip area 3 is to provide traction and friction for improved grip, but no too much to be uncomfortable or increase the risk of tearing skin while training.

Figure 5:
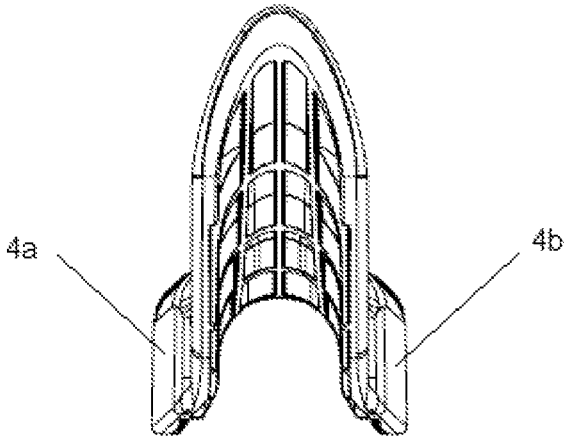
FIG. 5: This image illustrates a front/rear view of the detachable exercise ring accessory device.
Figure 6:
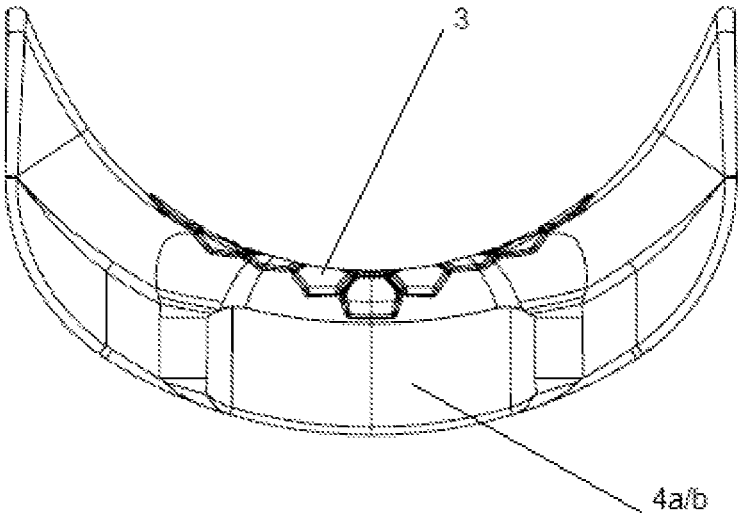
FIG. 6: This image illustrates a side view of the detachable exercise ring accessory device.

FIG. 5 shows the front/rear view while not attached to the ring 2. In this view, the underside ribbing can be seen. The ribbed design allows for strength and durability as well as the ability to flex shape and return to normal while sliding on and off thicker rings 2.

Figure 7:
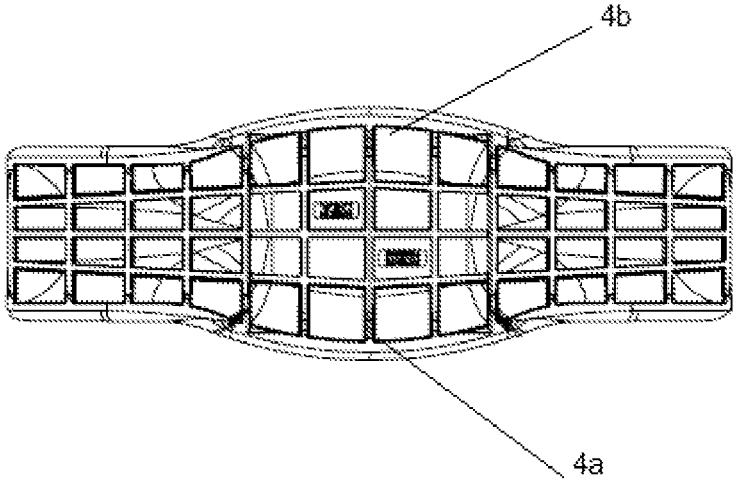
FIG. 7: This image illustrates a view of the underside of the detachable exercise ring accessory device.

FIG. 7 shows the underside of the device. In this view, the underside ribbing can be seen again. Additionally, the width of the material over the band cutout 4(*a*) and 4(*b*) can be seen.

What is claimed is:

1. An exercise ring accessory device comprising: a main body having an underside shaped to match a curvature of an exercise ring, the device being configured to removably couple, via tension between two lateral sides of the device, to an interior portion of the exercise ring and at least a portion of each of two lateral sides of the exercise ring.

2. The exercise ring accessory device of claim 1, wherein at least a portion of a material comprising the device is a hard rubber.

3. The exercise ring accessory device of claim 1, further comprising a cut out area on the underside for the accommodation of elastic bands.

4. The exercise ring accessory device of claim 3, wherein the cut out area is between 2" and 4" in width and between .1" and .25" in depth.

5. The exercise ring accessory device of claim 1, further comprising a hand grip area on a top side of the main body.

6. The exercise ring accessory device of claim 5, wherein the hand grip area is at a center of the exercise ring accessory device and, when attached to the exercise ring, is centered over a midpoint of the interior portion of the exercise ring.

7. The exercise ring accessory device of claim 5, wherein a width of the hand grip area tapers in thickness from a wider center point to narrower points at endpoints of the hand grip area.

8. The exercise ring accessory device of claim 7, wherein the width of the hand grip area is about 2.5" at the center and about 1.5" at the endpoints.

9. The exercise ring accessory device of claim 5, wherein the hand grip area comprises a textured gripping surface.

10. The exercise ring accessory device of claim 1, wherein the two lateral sides of the exercise ring accessory device are symmetrical.

11. The ring accessory device of claim 1, wherein the device measures between 6" and 8" in length.

12. The exercise ring accessory device of claim 1, wherein at least a portion of a material comprising the device is a plastic.

13. The exercise ring accessory device of claim 1, wherein the device is formed by injection molding.

14. The exercise ring accessory device of claim 1, wherein the device is further configured to be secured to the exercise ring via tension between each of two distal endpoints of the device.

* * * * *